US005809791A

United States Patent [19]

Stewart, III

[11] Patent Number: 5,809,791

[45] Date of Patent: Sep. 22, 1998

[54] REMORA II REFRIGERATION PROCESS

[76] Inventor: Thomas Ray Stewart, III, 1818 Rodd Field Rd. #A3, Corpus Christi, Tex. 78412

[21] Appl. No.: 589,416

[22] Filed: Jan. 22, 1996

[51] Int. Cl.[6] ..... F01K 23/04; F25B 27/00

[52] U.S. Cl. ..... 62/115; 62/238.4; 60/655

[58] Field of Search ..... 62/238.4, 116, 62/238.6, 115; 60/671, 651, 655

[56] References Cited

U.S. PATENT DOCUMENTS

| | | | |
|---|---|---|---|
| 2,952,138 | 9/1960 | Russell et al. | 62/238.4 |
| 3,478,774 | 11/1969 | Noakes et al. | 62/225 X |
| 3,851,494 | 12/1974 | Hess | 62/513 X |
| 4,342,200 | 8/1982 | Lowi, Jr. | 62/238.4 |
| 4,475,343 | 10/1984 | Dibelius et al. | 60/655 |
| 5,214,932 | 6/1993 | Abdelmalek | 62/332 X |
| 5,272,878 | 12/1993 | Schlichtig | 60/655 |

*Primary Examiner*—William E. Wayner

[57] ABSTRACT

A process that converts heat energy to kinetic energy comprising at least two fluid cycles thermally joined in which these fluids act as refrigerants. An initiating cycle capable of performing reversed Carnot refrigeration is the major source of heat energy driving the process, and does so by giving off heat energy largely obtained through evaporating and superheating its fluid by condensing its fluid to a reclaiming cycle by causing said reclaiming cycle to boil its fluid, and this boiled fluid expands and moves invoking kinetic energy with the use of a turbine or similar means which is utilized by applicably selected means. The fluid in the reclaiming cycle is then condensed by giving off remaining heat energy and may comprise options of being recycled in the process, rejected out of the process, or used to drive additional reclaiming cycles, or another Remora II process. Remaining heat energy resulting from applied energy employed to cause heat energy to move through the process is optimally used to provide additional brake energy to invoke kinetic energy.

15 Claims, 5 Drawing Sheets

REMORA II PROCESS

DENOTES CONTAINING CONVEYANCE FOR INITIATING CYCLE

DENOTES CONTAINING CONVEYANCE FOR RECLAIMING CYCLE

REMORA II PROCESS

FIG.2 REMORA II PROCESS

FIG. 3 REMORA II PROCESS

FIG.4 REMORA II PROCESS

REMORA II PROCESS

REMORA II REFRIGERATION PROCESS

BACKGROUND OF THE INVENTION

1. Field of the Invention

This invention relates mainly to the areas of the physical sciences comprised of refrigeration, and the understanding of means for making use of a boiling gas to induce kinetic energy comprising the application of turbines and/or turbine-like devices.

2. The Description of Prior Art

Prior art relating to the present invention (called the Remora II Refrigeration Process, that henceforth is at times referred to as the Remora II) are involved around two disciplines comprising: the principles of refrigeration; and the utilization of kinetic energy induced from boiling a refrigerant. We will first look at related art in the field of refrigeration.

From time to time, people have been dissatisfied with the amount of heat energy that may be present at one place, and desired that this heat energy be located in another place. The science of refrigeration brought about a method of solving this problem. The number of advances and various applications in refrigeration have been numerous throughout the years since about 1820, when it is believed that ice was first made artificially as an experiment.

Refrigeration devices move heat energy from where the user does not want it to where the user does by the use of a refrigerant. By evaporating the refrigerant, heat energy is removed from some heat source medium which is the source of that heat energy. In some cases this refrigerant is used and expelled, such as in evaporative coolers. In this case, water is usually the refrigerant and as it evaporates, it removes sensible heat from the air by converting it to latent heat. After this, the overall heat energy is still believed present in the air, but because the amount of sensible heat was reduced, the air has become a cooler temperature. In many cases, this is not a desirable method of refrigeration because water and other refrigerants are scarce and/or expensive and/or damaging to the environment. When they are expelled or lost, they must be replaced to continue the refrigeration. Also, an increase in latent heat in the conditioned medium (as in the evaporative cooler example) is not always acceptable nor desirable. Most refrigeration applications today are closed loop systems, where the refrigerant is contained. Such containment is comprised of the following: various vessels, piping, heat exchanging components that are used to condense the refrigerant (normally referred to an condensing coils), and heat exchanging components that are used to evaporate the refrigerant (normally referred to as evaporating coils or evaporators). The refrigerant is reused by evaporating it in order to cool or remove heat from a medium through an evaporator and condensing it to give off heat to a medium through a condensing coil that the user desires. Thus after the refrigerant condenses, it may then be re-evaporated and the cycle starts anew.

Refrigeration cycles fall into major categories comprising: Carnot refrigeration cycles; and reversed Carnot refrigeration cycles. Carnot cycles evaporate their refrigerant at a higher temperature than the refrigerant condenses at. Unless there should be needed costly applied energy to move the mediums to be cooled and warmed and/or control the process, heat energy will naturally flow through Carnot cycles and costly applied energy to cause that movement is believed minimal. Careful design that may be comprised of efficient condensing and evaporating surfaces between the refrigerant and mediums giving and receiving heat energy, siphoning action, gravity, convection, and/or other forces, may be sufficient to accomplish the task. A heat pipe is a notable device making use of the principle of Carnot refrigeration. On the other hand, reversed Carnot cycles usually evaporate their refrigerant at a lower temperature than the refrigerant condenses at. It is believed these cycles can require substantial applied energy to more the refrigerant and to raise the evaporated refrigerant to a higher pressure/temperature gas in order to accomplish the cycle. It is also believed that should a refrigeration cycle encounter a situation where the evaporation and condensing temperatures are the same, that applied energy is still required to move the refrigerant through the cycle, and this would also be considered a reversed Carnot cycle. It is believed that most refrigeration applications currently operate with reversed Carnot cycle principles.

It is believed that compressor driven reversed Carnot refrigeration machinery typically move more heat energy absorbed by their refrigerants than they consume in applied energy to drive the cycles, especially those that are referred to as high temperature applications, such as comfort air conditioners. Other reversed Carnot devices, such as absorption units, are believed typically not as efficient, and as much or more applied energy is believed used to drive their cycles than is absorbed at their evaporators. Therefore, compressor driven refrigeration is believed to be the more likely application for the Remora II.

It is believed that makers of these refrigeration devices have largely tried to minimize the amount of applied energy needed to make reversed Carnot cycles work by obtaining a condensing temperature of the refrigerant as low as practical for the particular application, and by obtaining an evaporation temperature of the refrigerant as high as practical for the particular application. Superheating the evaporated refrigerant and subcooling the condensed refrigerant is believed to further enhance the efficiency of the application, again within practical limitations.

In applications where the objective is to remove heat energy from some medium and reject it to wherever is the most practical (such as a comfort air conditioner), typically the apparatus dew point of the evaporator is believed to be a limiting factor in how warm the evaporation temperature and superheating during this said evaporation can be. In these incidents, it is believed that equipment makers have primarily concentrated on limiting and subcooling the condensing temperature of the cycle. Any heat absorbed by the refrigerant from the use of applied energy needed to drive the cycle is a burden to the objective and must be overcome when the refrigerant condenses.

In applications where the objective is to obtain heat energy to be added to some desired medium from another medium of least consequence and/or the most practical source (such as a heat pump when heating), then it is believed that the warmest evaporating temperature and superheating that is practically obtainable is desirable. It is believed that the most limiting factor to maximizing the evaporating temperature is if the evaporated refrigerant is the primary or only source of coolant for the refrigerant compressor. The coolest condensing temperature and subcooling practical for the application is also believed to be desirable. Any heat absorbed by the refrigerant from the use of applied energy needed to drive the cycle is additional heat and therefore assists in the objective. Because this added heat is the result of the use of applied energy rejected by the condensing refrigerant and is utilized by the process to obtain the objective, this situation is superior to the one in the previous paragraph. But it is believed that these applications do not typically perform for less applied energy per heat energy moved than comfort air conditioning applications referred to in the previous paragraph, because these applications typically do not permit the relative closeness in temperature of the condensing and evaporating refrigerant, as more moderate or high temperature applications such as comfort air conditioning.

Other notable advances making refrigeration applications more efficient are improved cycle driving devices that reduce the amount of applied energy needed to make the energy move through the refrigerant. These are comprised of increasing the efficiency of refrigerant compressors, fan motors, pumps, and controls.

Even with these efforts to make refrigeration machinery more efficient and, therefore, more affordable to use, it is believed that they have fallen well short of what advancements many users of these devices would like accomplished. Refrigeration can be very demanding on utilities supplying power for these devices, and it is believed that they can reek havoc due to peak load demand requirements on said utilities. It is believed that the current invention can help solve this problem.

Turbines and/or turbine-like devices have been used typically to utilize the energy of moving matter (usually a gas or liquid) to induce kinetic energy by spinning around the axis or axle of the turbine. A believed notable use of this kinetic energy is inducing electromotive force by turning an electrical generator and causing electrical current. As of this writing, it is believed that turbines designed to make use of larger amounts of brake energy of moving matter are typically more efficient.

Because of the belief of comparative scarcity and/or lack of dependability of natural forms of moving matter (such a falling water), it is believed that the use of turbines before the current invention have largely depended on moving matter that has been induced almost exclusively with the use of fuels. It is believed that because of the use of a large percentage of those fuels, this has caused damage to the planet and the environment, and many of these fuels may eventually become depleted.

Let us conclude the discussion of prior art with two related patents put forth by the Examiner: "Method for the Generation of Heat Using a Heat Pump, Particularly for Processes Run Only at High Temperatures" by Dibelius et al., U.S. Pat. No. 4,475,343; and "Azeotrope Assisted Power System" by Schlichtig, U.S. Pat. No. 5,272,878.

It is believed that Dibelius et al. taught a method which uses a heat carrier fluid that was made to obtain heat from a heat source which was at a lower temperature than at the point of its delivery by the use of a compressor. Specifically, it is believed that the basic method obtains heat into its heat carrier fluid from the heat source, compresses the gaseous carrier fluid in order to raise its temperature, gives off heat to some heat consumption, turns an expansion turbine, and then available heat still present in the heat carrier fluid is used in a second heat consumption process and returned to the heat source to start the process anew. This method is believed to be less optimal than the present invention because the turbine and the compressor are in the same fluid cycle, thus the turbine is driven not by a fluid changing from a liquid to a gas in a separate cycle, but by the compressor driven fluid already in its gaseous state that is expanded somewhat in the turbine. It is also believed that there is no express teaching by Dibelius et al. that the heat carrier fluid changes state from a gas to a liquid in order to take advantage of its capacity to absorb latent heat of vaporization from the lower temperature heat source. It is believed that it is stated in the claim that the heat carrier is always gaseous. Additionally, it might be assumed that Dibelius et al. was trying to convey that the addition of work at the compressor was the absorption of resulting heat energy from the work done by the compressor thus superheating or further superheating the gaseous carrier, but again this is believed not to be clearly taught. It is believed that merely raising the pressure of the gaseous carrier will raise its temperature, but not its enthalpy (or heat content). To conclude discussion of this art, it is believed that the method taught by Dibelius et al. is more practically applied to large industrial processes because the method is believed to favor rather high temperature consumption applications. The current invention is believed not to be limited in this manner.

Schlichtig's power system is very similar to the current invention, but there are notable differences that are believed to render the system significantly less optimal to the current invention. Schlichtig is believed to have taught a more restricted application of a particular machine design rather than a process, as does the current invention. What is believed to be a most notable difference in his teaching is that the first vapor cycle thermally joined to the second gives off its heat of vaporization to the cycle. It is believed that he does not teach any further heat energy given off to the condenser-boiler from the first cycle except at the heat exchanger between the two cycle's liquid refrigerants, nor does he claim it. Though the heat of vaporization in the first cycle is also the key energy of the current claimed process, the current invention optimally makes use of additional heat energy given off directly to the condenser-boiler (or boiler component) rather than just the heat of vaporization of the first cycle, thus resulting in believed superior performance by the allowance of optimally superheating the evaporated refrigerant to gain further working energy to boil the second vapor cycle's refrigerant when the first cycle condenses. Thus significantly more brake energy can be applied to the vapor motor (as referred to in the Remora II as the turbine component) in the current invention's teaching. Since both cycles' refrigerants are in a liquid state at the heat exchanger in Schlichtig's teaching, it is believed that if any superheating was present in the first cycle's gaseous refrigerant it cannot be given off at this heat exchange, therefore it must be assumed from his teaching that the first cycle's gaseous refrigerant was not superheated because it is believed this said superheating must be given off to the second cycle's refrigerant in the boiler-condenser prior to the condensing of the refrigerant so this said condensing can take place.

Schlichtig also teaches that external fins could be provided on the exterior of the boiler-condenser to discharge a portion of the heat delivered by the condensing first cycle. This is believed to be a loss of brake energy available to drive the vapor motor and therefore lowers the efficiency of the power system. Though the possible loss of heat energy due to transmittance from components is dealt with in the teaching of the current invention, this is not specifically taught as a preferred or optimal embodiment of the invention.

It is also believed that Schlichtig teaches the linking of the vapor motor with the compressor using a speed controller in order to raise or lower the speed of the compressor in order maintain a proper vapor pressure and temperature in the boiler portion. If this power system were being used as a means of cooling the heat source element he speaks of, such as in a cooling refrigeration application, then it is believed that lowering the compressor speed might be undesirable, due to the fact that cooling the heat source element is of primary importance and that lowering the compressor speed is believed to cause a loss of system capacity to remove heat from the heat source element. This limitation is not taught in the current invention. Control of the process is left to those applying it, and other methods of handing heat energy in the process are left up to their discretion.

Schlichtig's requirement of an azeotrope refrigerant being used in the first vapor cycle, and the two examples of azeotrope refrigerants he cites, are believed questionable. It is believed to be assumed that Schlichtig is trying to convey that the use of an azeotrope will significantly improve the efficiency of such said cycle, particularly those that he gives examples of. It is believed, as was discussed earlier in reviewing the prior art, that the most significant factors that affect reversed Carnot cycle efficiencies is obtaining the coolest condensing temperature(s) and the warmest evaporating temperature(s) of the refrigerant(s) practical for the particular application(s). It should also be noted that it is believed that there are currently a rather limited number of available true azeotropic refrigerant mixtures, and that Schlichtig is again believed to be unduly limiting his application when single refrigerants or near azeotropes may be usefully applied.

The known azeotropic refrigerants available as of 1993 classified by the refrigeration industry standard (ANSI/ASHRAE Standard 34-1992) are believed to be comprised of the following: R-500 composed of 73.8% R-12 and 26.2% R-152a; R-501 composed of 75% R-22 and 25% R-12; R-502 composed of 48.8% R-22 and 51.2% R-115; R-503 composed of 40.1% R-23 and 59.9% R-13; R-504 composed of 48.2% R-32 and 51.8% R-115; R-505 composed of 78% R-12 and 22% R-31; and R-506 composed of 55.1% R-31 and 44.9% R-114. It is also believed that R-507 composed of 50% R-125 and 50% R-143a is also an azeotrope. The two blends Schlichtig teaches are: 78% R-22 in R-134a; and 18% R-152a in R-134a. Based on the above listing, neither of these blends are believed to be known industry rated azeotropic mixtures. Therefore, if these are not true azeotropes, then they are believed to be zeotropes or NARMs (near azeotropes). It is believed that true azeotropes behave as single refrigerants within normal operation ranges having predictable pressures with corresponding saturated temperatures. Such near azeotropes are believed to behave differently than true azeotropes, possessing notable temperature glide during normal operation, and should this concern be applicable, it is then believed that it was not clearly taught by Schlichtig and is therefore confusing. The teaching of the current invention leaves the choice of refrigerant(s) to those applying the process, which is believed to allow the current invention a wider range of applications.

Another believed shortcoming of Schlichtig's teaching is the inclusion of the hydraulic motor in the first cycle which is believed to be considered an integral part of the machinery. This hydraulic motor, though located in a believed reversed Carnot cycle in which its refrigerant changes state, is believed to have a similar drawback to the expansion turbine discussed in the teaching Dibelius et al. This hydraulic motor performs work and requires energy to do work. It is believed that more brake energy is needed to drive this said motor (or believed turbine) than can be utilized by it. Even if an advance in known technology should allow all of the brake energy against this hydraulic motor to be utilized, it is believed that there would be no gain of energy here and would only allow this resistance in the cycle back to energy equilibrium. Therefore, it is believed that this will increase the work load on the compressor, causing it to consume more energy in order to pump refrigerant throughout the cycle. Because it is believed that Schlichtig teaches only the heat of vaporization is given off to the boiler-condenser from the first cycle directly from the compressor, any possible superheating derived from heat energy from the added work of the compressor cannot be utilized or partially utilized in the second cycle through its vapor motor. Therefore, it is believed that this hydraulic motor, especially considering believed current technologies, actually causes increased energy usage and lowered performance thereof. Placing turbines in the first cycle (referred to as the initiating cycle in the current invention) is not taught in the writings of the Remora II. It is believed that the vapor engine in the second cycle (or the turbine component in the reclaiming cycle of the current invention) has value because it makes use of thermal energy absorbed by the refrigerant(s) rather than entirely on mechanical energy moving a fluid provided by the compressor (or the refrigerant driving component referred to in the current invention). The believed value of utilizing heat energy in the said refrigerant(s) is that less driving energy (or applied energy in the current invention) is needed to move heat energy into the boiler component than is the total equivalent heat energy moved into the boiler component.

In closing the discussion of Schlichtig's teaching, it is believed that he did not mention the potential of making use of heat energy which was being rejected at the condenser by transferring this heat energy back to the evaporator, driving another reclaiming cycle, nor another power system, as is discussed in the current teaching.

Two more patents submitted later during the proceedings are worth mentioning, U.S. Pat. Nos. 2,952,138 by Russell et al and 5,214,932 by Abdelmalek. Both teach the use of two thermally joined refrigerant cycles employed to obtain kinetic energy. However, Russell et al must obtain energy other than from one cycle giving off energy to the other cycle, and both teach that the kinetic energy can only be used on a common shaft between an expander and a compressor and liquid pump to help reduce energy used. The teachings fall way short of the current invention, because what is taught by the current inventor is a process that can have many applications.

SUMMARY OF THE INVENTION

The major object of the present invention (the Remora II) is to make added use of heat energy that moves through the refrigerant(s) of the process by employing a means of utilizing said heat energy to induce kinetic energy in some usable form.

The Remora II is a process that, in its most basic form, is comprised of: an initiating reversed Carnot refrigeration cycle (or a cycle that has the potential of reversed Carnot refrigeration); and a reclaiming cycle. Available heat energy is drawn into the process comprised of evaporating refrigerant of the initiating cycle and optimally immersing (depending on the need(s) of the application) immersing sources of heat energy into refrigerant(s) of the process by applicably selected means so as to absorb that heat energy by said refrigerant(s) in a manner that can act as brake energy to drive the said means of inducing kinetic energy. The initiating cycle gives off available heat energy when condensing its refrigerant through boiling the refrigerant of the reclaiming cycle. The condensed refrigerant of the initiating cycle may be returned to its means of evaporation to be re-evaporated. As the refrigerant of the reclaiming cycle boils, it expands and moves and is utilized by applicably selected means to induce kinetic energy in some useful form, which is used for some purpose. The reclaiming cycle's refrigerant may then be condensed (or further condensed) and returned to its means of boiling to be re-boiled. The remaining heat energy expelled when the reclaiming cycle's refrigerant is condensed may optimally (depending on the need(s) of the application) be reused in the process applicably selected means.

DETAILED DESCRIPTION OF THE INVENTION

Figure 1:
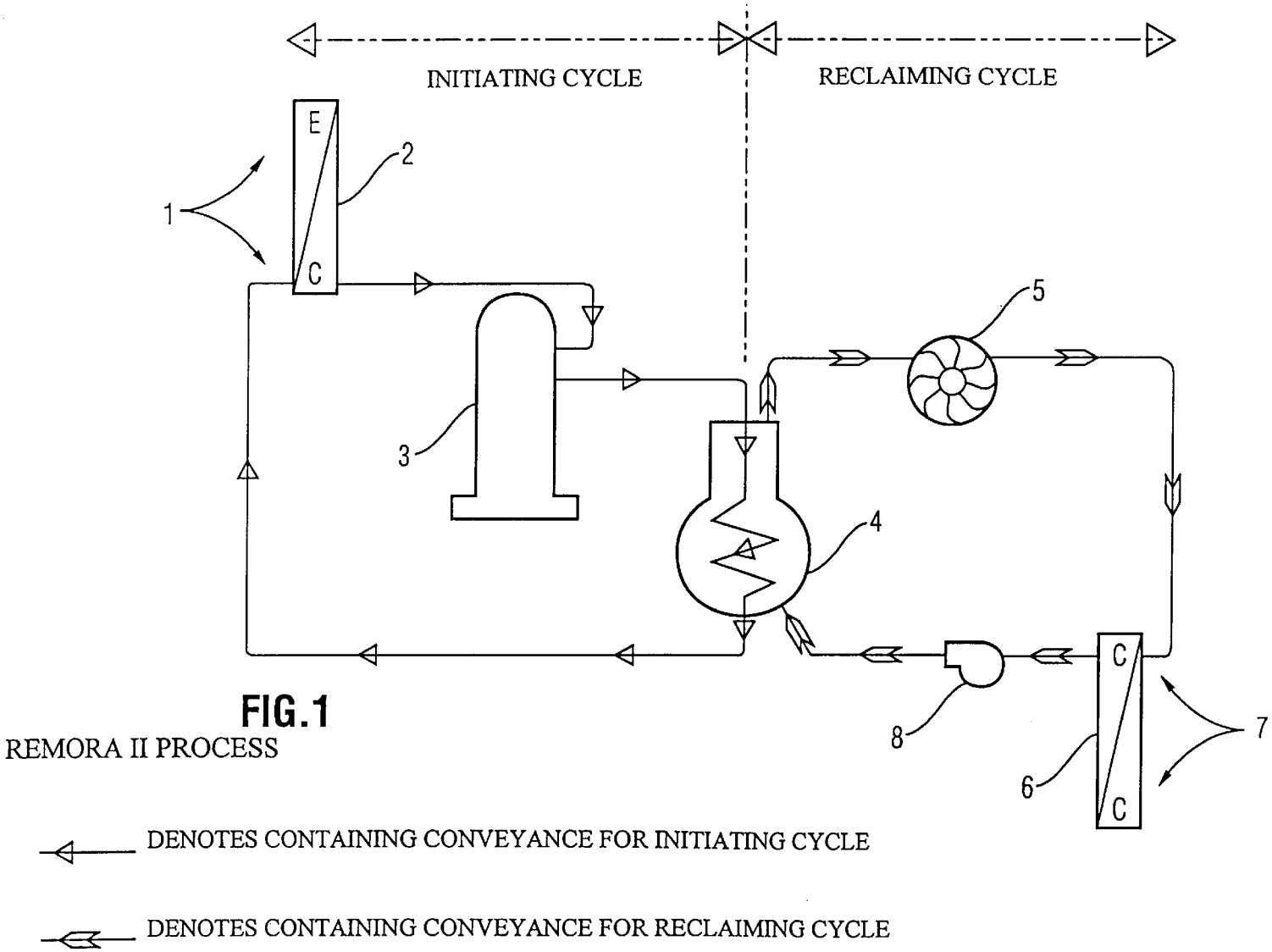
FIG. 1 is a diagrammatic representation having no special scaling of some generalized components illustrating the basic application of the present invention.

Though the present invention (the Remora II) is a claimed process, it will be easier to describe and understand it by presenting it as simplistic diagrammatic representations of machinery applications. Because it is believed that there are a large number of varied applications and/or potential applications that may make use of the present invention, it is believed a practical impossibility to list all the various components and/or parts that one may employ in applying the Remora II. Therefore, those applying the Remora II are believed to have proficiency in the manufacturing and design of mechanical equipment, particularly in the field of refrigeration, and/or use of the kinetic energy as a result of applying the Remora II. They must themselves be able to determine various components and/or parts that best suit their particular application(s).

For example, representations of the the Remora II in this writing make use of an evaporating component (as will be defined later) to evaporate a refrigerant. Such components, usually referred to as evaporators or evaporator coils, are believed (at the time of this writing) to employ the use of refrigerant metering devices. It is believed that such metering devices may be located on or in very close proximity to the evaporator, or they may be remotely located. Such metering devices may be comprised of: bleeding expansion valves; non-bleeding expansion valves; flow control check valves; capillary tubes; etc. These metering devices vary due to differing applications and/or preferences, therefore, it is believed to be impossible to declare which metering device is always best used when applying the Remora II and/or where such device is always best located in regard to component locations.

More specifically, various components and/or devices and/or parts are not dealt with in detail in the discussion of the present invention because a particular form of machinery is not claimed, and in order to maintain a relative simplicity in allowing us to focus on what is taking place with the process called the Remora II. These various components and/or devices and/or parts that are not dealt with are comprised of: thermostats and controls; transformers; electrical parts such as contactors, capacitors, and electrical wiring; check valves; refrigerant switchover valves; specific performances and/or capacities of fan motors and pumps, and whether they are needed in some specific application or not; performances and/or capacities and/or types of various refrigerant compressors and whether they need crankcase heaters or not; the type of refrigerant(s); starting accessories; suction accumulators; solenoid valves, and whether such valves should be two position or multi-position; methods taken to make sure oil doesn't collect in pockets in the refrigerant cycle(s) that is undesirable; refrigerant equalizing tubes; and the like. What is discussed is the application of various generalized components as means for applying the process.

These generalized components will be described as to what they do and how they are applied in the process. Their individual performance(s) is not a claim of the Remora II. Therefore improvements in technology of these generalized components, or developments and/or other components that may accomplish the same objectives (or improved objectives) of these generalized components diagrammatically depicted here, are not a claimed part of this patent, but may be utilized when applying the Remora II in the present and/or the future. Because of the potential of invention and advancement of these generalized components, at times these instructions that deal with situations that may occur when making use of said generalized components (which may not be typical at the time of this writing) are an attempt to guide the user of the present invention, being a process, if potential advances in the said generalized components do indeed occur.

When describing the series of events of the process throughout this writing, it may appear as if these events are happening in a sequential fashion. This is not the case and/or not always the case. Once the process is in operation, when available heat energy is fully moving through the refrigerant (s) of the process, and all described events are proceeding, the events are taking place simultaneously in a cyclical fashion. But because they go through a series of events where refrigerant is evaporated, condensed, boiled, etc., the description of these events are done in a sequential fashion.

The basic Remora II process is comprised of: an initiating reversed Carnot refrigeration cycle (or a cycle that has the potential of reversed Carnot refrigeration); and a reclaiming cycle containing a refrigerant that is believed to evaporate at a higher temperature than it condenses at. What is meant by "potential of reversed Carnot refrigeration" is that, at times, reversed Carnot machinery may encounter situations when they evaporate their refrigerant at a higher temperature than they condense it at, and this would be believed functionally unusual and assumed not to be a dominating occurrence. Even if this were not a functionally unusual occurrence, the fact that this cycle would have some ability to gain from reversed Carnot refrigeration principles at times is believed to cause it to be encompassed by this patent. Referring to FIG. 1, we see a basic representation illustrating means of applying the Remora II, which may be comprised of the following generalized components: a heat source medium 1; an evaporating component 2; a refrigerant driving component 3; a boiler component 4; a turbine component 5; a condensing component 6 (which is believed to be necessary); and a heat rejection medium 7. If there should be sufficient resistance in the reclaiming cycle causing a pressure differential during its operation that would prevent liquid refrigerant of the reclaiming cycle from returning to the boiler component, then it is believed that the components should also include a boiler returning component 8. Refrigerant containing conveyances shown in the drawing connect all of the above accept the heat source medium and the heat rejection medium. These mediums are not actually shown in the drawings, but are assumed to be functionally around the evaporating and condensing components, and therefore they are identified in the drawings by numbers with arrows representing that they are in close proximity acting on those components.

The heat source medium 1 is a medium that contains heat energy that is removed from this medium by coming in contact with the external surface of the evaporating component at some rate of extraction and/or range of extraction rates. The heat source medium may be comprised of: a gas; a liquid; a solid substance; a space that allows radiant energy to pass through it and strike the surface of the evaporating component; or a refrigerant that is most likely condensing. It is believed the medium may be some various combination of these.

The evaporating component 2 is a means of evaporating the refrigerant of the initiating cycle. It is a heat exchanger that facilitates the movement of heat energy from the heat source medium to the evaporating refrigerant of the initiating cycle by coming in contact with that medium with its external surface. The heat energy transfers from the external surface to the internal surface of this component. Its internal surface contains refrigerant that is believed to enter this component as a liquid (or largely as a liquid) through a containing conveyance from the boiler component (and through any appropriate metering device) and evaporates in the component, and optimally (depending on the need(s) of the application of the process) picks up superheating in the component. This believed evaporated refrigerant then leaves the evaporating component and is drawn into the refrigerant driving component through a containing conveyance.

The refrigerant driving component 3 is a means of raising the pressure and temperature of the evaporated refrigerant of the initiating cycle so it can condense in the boiling component. It is believed to be a major force that causes the refrigerant of the initiating cycle to move from the evaporating component to the boiler component, and throughout the cycle. And with the heat energy it drives along in the refrigerant, is believed to be a major cause of refrigerant movement in the reclaiming cycle. It receives refrigerant of the initiating cycle from the evaporating component through a containing conveyance, and raises the temperature and pressure of that refrigerant when performing reversed Carnot refrigeration (which is believed to be typical operation). It then sends this higher pressure/temperature gaseous refrigerant (which is believed to be typical operation) through a containing conveyance to the boiler component.

The boiler component 4 is a means where the major exchange of heat energy is believed to take place from the initiating cycle to the reclaiming cycle. The component is a containment shell with a heat exchanger inside it. The initiating cycle's refrigerant gas leaving the refrigerant driving component travels through a containing conveyance to the heat exchanger and travels through it, giving off heat to the internal surface of the heat exchanger and condensing the initiating cycle's refrigerant. It is believed that this condensed refrigerant of the initiating cycle may be optimally (depending on the need(s) of the application of the process) subcooled in or as it leaves the boiler component. The believed condensed refrigerant then leaves the boiler component by a containing conveyance and returns to the evaporating component to be re-evaporated. The heat energy given off by this condensed initiating cycle's refrigerant travels from the internal surface of the heat exchanger to the external surface of the heat exchanger. While the aforementioned events are taking place, liquid (or largely liquid) refrigerant of the reclaiming cycle is entering the containing shell of the boiler component by way of a containing conveyance from the condensing component by probable additional force provided by the boiler returning component (as discussed earlier). This liquid (or largely liquid) refrigerant comes in contact with the external surface of the heat exchanger and receives heat energy, thus boiling the refrigerant of the reclaiming cycle. This boiled refrigerant of the reclaiming cycle then leaves the boiler containment shell through a containing conveyance to the turbine component.

The turbine component 5 is a means used to induce kinetic energy by spinning an axis or axle that is driven by expanded boiled refrigerant of the reclaiming cycle leaving the boiler component by way of a containing conveyance. This boiled refrigerant drives through the turbine's refrigerant containment and spins the internal portion of the turbine component by pushing on its blades and/or expanding energy capturing devices that are attached in some fashion to the axis or axle. The reclaiming cycle's refrigerant leaving this turbine component goes by way of a containing conveyance to the condensing component (which is believed to be necessary).

The condensing component 6 is a means of condensing the refrigerant of the reclaiming cycle. It is a heat exchanger that facilitates the movement of heat energy from the refrigerant of the reclaiming cycle leaving the turbine component to the heat rejection medium in order to condense that refrigerant by coming in contact with that medium with its external surface. Its internal surface contains the reclaiming cycle's refrigerant that enters this component through a containing conveyance from the turbine component and condenses in the condensing component, and optionally subcools in the condensing component in order to help ensure condensing of the refrigerant. The heat energy given off by said condensing refrigerant transfers from the internal surface to the external surface of the condensing component where it comes in contact with the heat rejection medium, which accepts the energy from the component. The believed liquid refrigerant of the reclaiming cycle leaves the condensing component by way of a containing conveyance to the boiler component, probably by way of the boiler returning component. Though it is believed unlikely, if all condensing of the reclaiming cycle's refrigerant and desired subcooling took place in the turbine component, then the condensing component is believed not to be needed.

The boiler returning component 8 is a means of force that may be required to return the reclaiming cycle's liquid refrigerant to the boiler component if (it is believed) there should be enough resistance through the reclaiming cycle to cause a pressure differential in the cycle that would prevent the believed liquid refrigerant from returning to the boiler component.

The heat rejection medium 7 is a medium sufficient to receive heat energy given off at the external surface of the condensing component. This heat rejection medium may be comprised of: a gas; a liquid; a solid substance; a space that can receive radiant energy; or a refrigerant that is most likely evaporating. It is believed that the medium may be some various combinations of these.

In this writing, I refer to available heat energy, applied energy and spent heat energy. Available heat energy is heat energy that is at a sufficient temperature to be utilized by the application of the, process, that is absorbed by the refrigerant(s) of the process by applicably selected means. A portion of this available heat energy may be comprised of spent heat energy. Applied energy is the total energy used by the Remora II to cause available heat energy to move through the refrigerant(s) of the process and/or is energy that is integral in some way in facilitating the process. Some examples of this are comprised of: electrical energy used by a fan moving air, in which the air is being used as a heat source medium and/or a heat rejection medium; wind or convection currents, in which the air that is being moved is being used as a heat source medium and/or a heat rejection medium; energy used in controlling the process; energy used by a crankcase heater; energy used to provide force that may be needed to return liquid refrigerant of the reclaiming cycle back to the boiler component; etc. Spent heat energy is the resulting heat energy, or the remaining heat energy, that is present after the applied energy has done its work, and which may optimally (depending on the need(s) of the application of the process) be made into available heat energy by applicably selected provided means.

Let us consider one possible example of spent heat energy and its possible interactions with the Remora II. Assume that there is spent heat energy present on the surface of a fan motor as it moves the air across an evaporating component and that fan motor is located upstream of the air moving across the evaporating component. Also assume that this spent heat energy is absorbed by the air as it moves across it. Assume this air is the heat source medium present inside a house. Some of this spent heat energy absorbed by the air will come in quick contact with the evaporating component and is absorbed by it, thus becoming available heat energy, but some of it bypasses the coil due to a small portion of that air that does not contact the evaporating component. The spent heat energy present in this bypassed air mixes with the rest of the air in the house, but it may be absorbed by the evaporating refrigerant when this mixed air repasses the evaporating component at a later time, provided that this bypassed heat energy is not lost to transmittance due to a cooler temperature outside the house and/or the ducts carrying the air, or through infiltration losses. However, if the fan motor is located downstream of the evaporating component, then the fan motor's spent heat energy will not quickly be absorbed by the evaporating component, but mix with the house's air as the bypassed air mentioned before.

It is believed that the major source of brake energy used by the Remora II to drive the turbine component is the available heat energy that is absorbed by applicably selected means by the refrigerant(s) of the process in such a manner as to act on the turbine component. Depending on the particular application, some of this available heat energy may be lost through transmittance at the various components and/or refrigerant containing conveyances used. Spent heat energy may also be made available heat energy if it too is absorbed with the use of applicably selected means by the refrigerant(s) of the process in such a manner as to act on the turbine component. It is believed that the most notable way that available heat energy is absorbed by the process is by the evaporating refrigerant of the initiating cycle. But, it is believed, that available heat energy may also be absorbed comprising superheating the initiating cycle's evaporated refrigerant by applicably selected means which enters the boiler component and/or adding heat energy to the condensed refrigerant(s) of the initiating and/or reclaiming cycles by applicably selected means (which is not believed to be a major method of available energy absorption). It is believed that adding this heat energy to the condensed refrigerant(s) can raise the evaporating and/or boiling temperature of them, unless pre-evaporating and/or pre-boiling of the condensed refrigerant(s) is allowed by applicably means so as to allow heat energy to be absorbed without causing a rise in the current optimal evaporating and/or boiling temperature for the application before, or as, they enter the evaporating component and/or the boiler component. It is believed that raising the temperature of the condensed refrigerant of the initiating cycle would be acceptable, provided that the evaporation temperature is not made warmer than desired for some reason and/or does not raise the temperature that the refrigerant condenses at so as to cause a loss of efficiency of the cycle. To explain, it is believed that it is okay to raise the temperature of the condensed refrigerant a little, as long as the evaporating temperature is raised sufficiently to keep the energy efficiency ratio of the cycle at an equal or greater value. If, however, pre-evaporating of the initiating cycle's condensed refrigerant is desired, it is believed that optimally it should be done after it passes all applicable refrigerant metering devices used by the evaporator component. Optimally, it is believed that the condensed refrigerant of the reclaiming cycle should be pre-boiled so as not to raise its current optimal boiling temperature for the application in order to facilitate a more efficient initiating cycle.

It is believed in most applications using the present invention, that available heat energy that is comprised of heat energy other than spent heat energy will typically and/or largely be absorbed with the use of the initiating cycle's evaporating refrigerant, and that spent heat sources will typically and/or largely be absorbed by immersing those sources of spent heat energy into the refrigerant(s). But this may not be the case in all applications. In further discussing possible methods to make spent heat energy available heat energy by absorbing said spent heat energy into the refrigerant(s) of the cycle, they may comprise: immersing the source(s) of that heat energy into refrigerant(s) of the process which is at a sufficiently high temperature to be absorbed by the refrigerant(s) in a way as to provide brake energy to drive the turbine component (as previously discussed); and/or immersing the source(s) of that heat energy into the heat source medium in such a way as to facilitate absorption at the evaporating component into the initiating cycle's refrigerant at some time interval, depending on the functional remoteness of the absorbing heat source medium from the evaporating component, and depending on how much of that energy is lost due to transmittance from the medium and/or infiltration into the medium during the time interval (as was discussed earlier regarding motor heat being added to the air of a house); and/or using spent heat energy that is radiant heat energy and/or converted radiant heat energy, and directing that said radiant energy directly at the evaporating component through a space (that space being considered a heat source medium), and the evaporating component is receiving radiant energy from that space, and the amount of spent radiant energy absorbed by the evaporating component will depend on the component's absorbtivity and any obstruction(s) between the component and the radiant energy's source(s) that would absorb and/or deflect that energy from the evaporating component's surface(s); and/or coming in direct contact with the source(s) of that spent heat energy at the external surface(s) of the evaporating component and/or the evaporating refrigerant. Again, specific representations of each possible method is believed too numerous to be practically dealt with in this writing and/or are yet to be invented. There are many possible configurations of heat transfer that are not novel that are believed known by those who apply refrigeration. Please make yourself aware of these and keep abreast of new methods of heat transfer when applying the present invention.

Some possible examples of spent heat sources and/or other heat sources that are not specifically designated as spent heat, which would be considered as sources of heat from outside of the process, may comprise: the surfaces of the components heated by the spent heat energy and/or heated surfaces due to sources of heat outside of the process; radiant bodies comprised of spent heat or other heat energy from outside the process directed at the evaporating component; the surfaces containing some mediums contained and/or moving within heat exchanging components that would facilitate removing the spent heat energy from the heated components and/or other heat sources outside of the process; the surfaces of the condensing components of Carnot refrigeration cycles extracting spent heat energy from the heated components and/or other heat sources outside of the process; the surfaces of the condensing components of reversed Carnot refrigeration cycles extracting spent heat energy from the heated components and/or other heat sources outside of the process; the surfaces of the condensing components of other Remora II processes extracting spent heat energy from the heated components and/or other heat sources outside of the process; etc. The sources of the spent heat energy and/or other heat energy must be at a temperature sufficient to promote absorption by the refrigerant. Specific representations of each possible heat source is believed too numerous to be practically dealt with in this writing Let us consider an example of absorbing spent heat energy into the refrigerant of the initiating cycle by immersing the source of that spent heat energy in refrigerant by superheating (or further superheating) the evaporated refrigerant of the cycle. Typically, it is believed that the major user of applied energy in the process is the refrigerant driving component. If this component is completely immersed internally in evaporated refrigerant of the initiating cycle (such as a hermetic compressor), then all (or practically all) of the spent heat energy is believed to be added to the refrigerant at the time of raising the refrigerant's pressure and temperature. If this component is not completely immersed internally in the refrigerant (such as a compressor with an out-driven motor), then it is believed that the refrigerant will not fully absorb the spent heat energy. To reclaim that heat energy not absorbed, it is believed it would have to be transferred back in some fashion like those dealt with in the previous paragraph.

As compared to a more conventional reversed Carnot cycle which is not making use of a reclaiming cycle with a turbine component not an added heat exchange at a boiler component, acting upon an identical heat source medium and and identical heat rejection medium (that is having the same matter and heat composition) as used by a comparative Remora II process, with a given amount of heat energy absorbed at the evaporating components of the more conventional reversed Carnot cycle and the Remora II, it is believed that the Remora II will require additional applied energy to overcome resistances encountered by the process due to work in the reclaiming cycle, as has been previously discussed.

Figure 2:
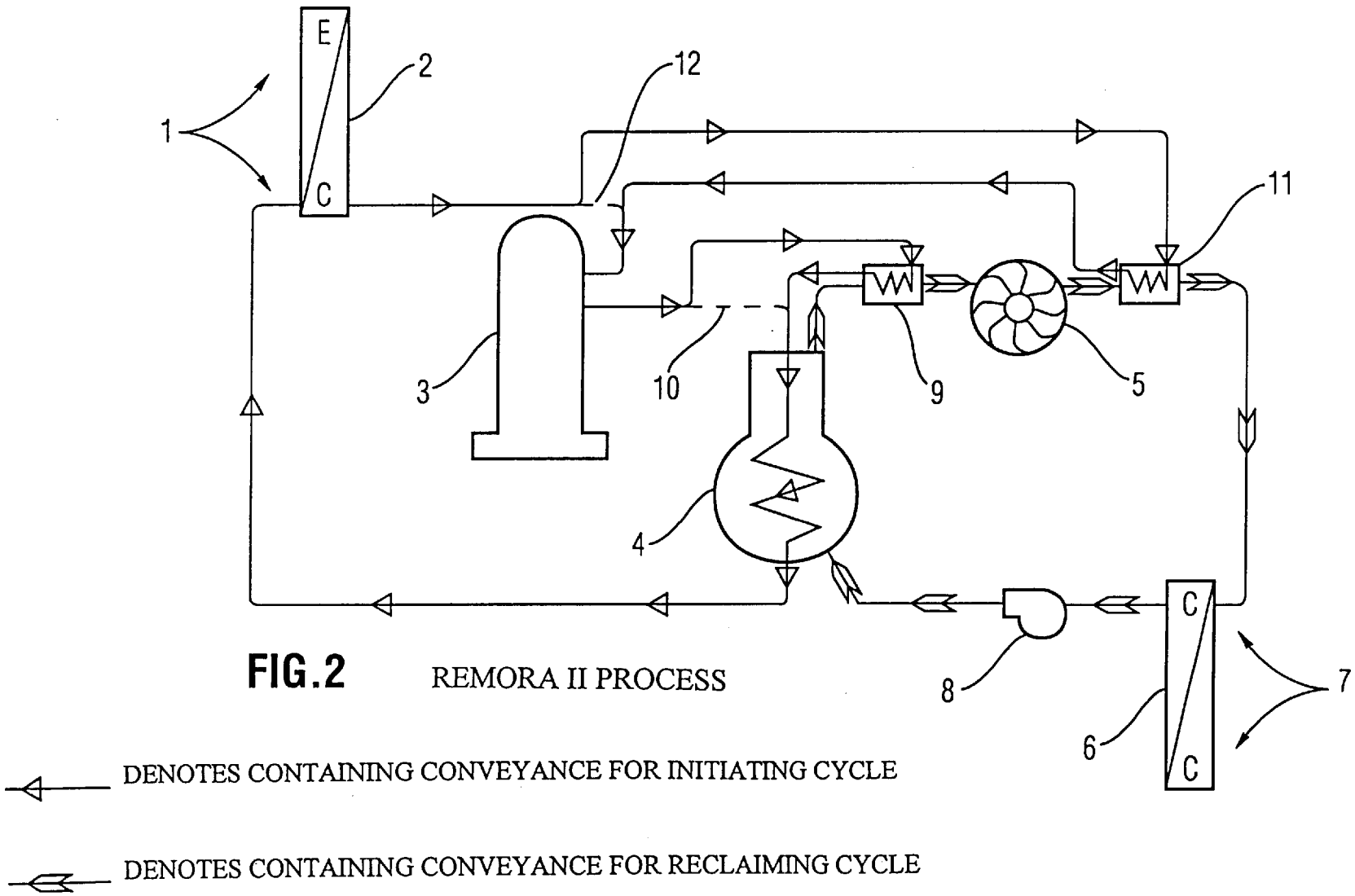
FIG. 2 is a diagrammatic representation having no special scaling of a suggested method of superheating the boiled refrigerant of the reclaiming cycle acting on a boiler component, and a suggested method of obtaining added superheating for the evaporated refrigerant of the initiating cycle, which pertain to possible situations applying the present invention.

If the gas refrigerant of the reclaiming cycle leaving the boiler component (by way of a containing conveyance) which drives the turbine component should encounter a loss of enthalpy at the turbine component as to cause condensing or partial condensing of the refrigerant while acting on the component, and such said condensing or partial condensing would cause harm to the turbine component and/or be undesirable in some fashion, then the refrigerant gas leaving the boiler must be superheated sufficiently to prevent this said unwanted condensing or partial condensing in the turbine component. Refer to FIG. 2 to see a suggested method of obtaining this added superheating. The refrigerant gas of the initiating cycle leaving the refrigerant driving component 3 is believed to be at a higher temperature than the refrigerant gas of the reclaiming cycle leaving the boiler component 4. This hotter gas travels through the inside of a heat exchanger which is inside of a refrigerant containment 9 giving off heat energy to the internal surface of the exchanger on way to the boiler component 4, as discussed earlier. This heat transfers from the inside surface to the outside surface of the heat exchanger. The reclaiming cycle's gas leaving the boiler component 4 passes over the exterior of the heat exchanger inside the containment and is believed to receive enough additional heat energy to prevent the unwanted condensing or partial condensing in the turbine component 5 on the way to that component. The dotted line 10 shows the path of the initiating cycle's refrigerant depicted in FIG. 1. This is a diagrammatic representation showing a separate component. This exchange of heat energy could possibly be accomplished in the boiler component containment itself, if the entering higher temperature gas of the initiating cycle were facilitated by applicably selected means to give off heat energy to the gas of the reclaiming cycle leaving the boiler component.

This superheating is believed to be a loss of brake energy that could be available to the reclaiming cycle's refrigerant acting on the boiler component, because the superheating only raises the temperature of the gas, but does not raise its effective power because it does not contribute to further boiling of it. Because of this, it is believed that this said superheating used to prevent unwanted condensing or partial condensing in the turbine component is not a preferred embodiment of the present invention. For this reason, it is believed that it may be better to use a turbine component application that allows partial condensing (or, though believed unlikely, full condensing in some applications) of the refrigerant in the component. For example, if partial condensing in the turbine component 5 is damaging because of a high rpm of this component, then it may be better to use a turbine component with lower rpm, and then use gearing to change the rpm to a desired utilization. But if lowering the rpm of the turbine component 5 would cause some loss in effective utilization of the brake energy being applied against it, and that loss in effective utilization would be greater than the loss due to superheating, then it is believed that the superheating would become an acceptable embodiment in this case.

If the superheating must be done as discussed in the previous paragraph, and in order to compensate for this believed loss of brake energy, we must gain additional available heat energy and/or recycle some of this available heat energy. Some methods of gaining this heat energy are comprised of: increasing the designed rate of extraction of available heat energy into the evaporating initiating cycle's refrigerant from the heat source medium 1; and/or gain additional superheating of the initiating cycle's refrigerant that is inside and/or leaving the evaporating component on way to and/or at and/or leaving the the refrigerant driving component 3. An increase in the rate of extraction is believed to mean increase in the overall capacity of the initiating cycle, and it is believed this means we must use more applied energy. Any additional spent heat energy from the additional applied energy may, optimally (depending on the need(s) of the application of the process) be absorbed into the refrigerant(s) of the process and some portion of it may be utilized, as discussed earlier. Gaining additional superheat in the evaporated refrigerant of the initiating cycle may also increase applied energy and spent heat energy. This is believed to take place if the evaporated refrigerant containing the extra superheating was used as a coolant for a compressor being used as a refrigerant driving component 3.

An interesting possible source of superheating of the evaporated initiating cycle's refrigerant is also depicted in FIG. 2. The method is similar to the other component shown in FIG. 2 just discussed. It is useful when the evaporating component temperature is critical to some condition that is being maintained of the heat source medium 1, and getting additional superheating at the evaporating component 2 would make that component warmer than desirable. The gas refrigerant of the initiating cycle leaves the evaporating component 2 and travels through a containing conveyance to the heat exchanger which is inside a refrigerant containment 11 and absorbs the superheating energy from the interior surface of the exchanger, which has been warmed by remaining available heat energy which is believed to be present in the refrigerant of the reclaiming cycle leaving the turbine component 5 by way of containing conveyance, by contacting the reclaiming cycle's refrigerant with the exterior surface of the exchanger that is containing said reclaiming cycle refrigerant with the outer shell of the heat exchanging component 11. Heat energy is transferred from the external surface to the internal surface of the exchanger. The refrigerant of the reclaiming cycle that has given off heat energy continues by way of containing conveyance to the condensing component 6 (if still needed) and the refrigerant of the initiating cycle that received the heat energy continues by way of containing conveyance to the intake of the refrigerant driving component 3. The dotted line 12 shows the path of the initiating cycle's refrigerant that was depicted in FIG. 1. Therefore, it is believed that the heat energy present in the reclaiming cycle's refrigerant entering the condensing component 6 has been reduced, and if this reduction of energy is undesirable (such as when heating the heat rejection medium serves some purpose), then this loss of heat energy must be compensated for, as discussed in the previous paragraph.

This method of obtaining superheating of the initiating cycle's refrigerant is by no means the only believed method available. I presented it because I felt that it may not be obvious to many of those applying the process. Some other sources may be comprised of: heat energy extracted in some fashion from the condensing component; spent heat energy; sources of energy outside the process; etc. In order to maintain simplicity in the remaining drawings, these two heat exchangers 9 and 11 with containing shells will not be depicted, and discussion of superheating in this context will not be detailed throughout the rest of this writing in order that we may concentrate on other issues affecting the Remora II. But you should remain cognizant of them and their purposes.

Figure 3:
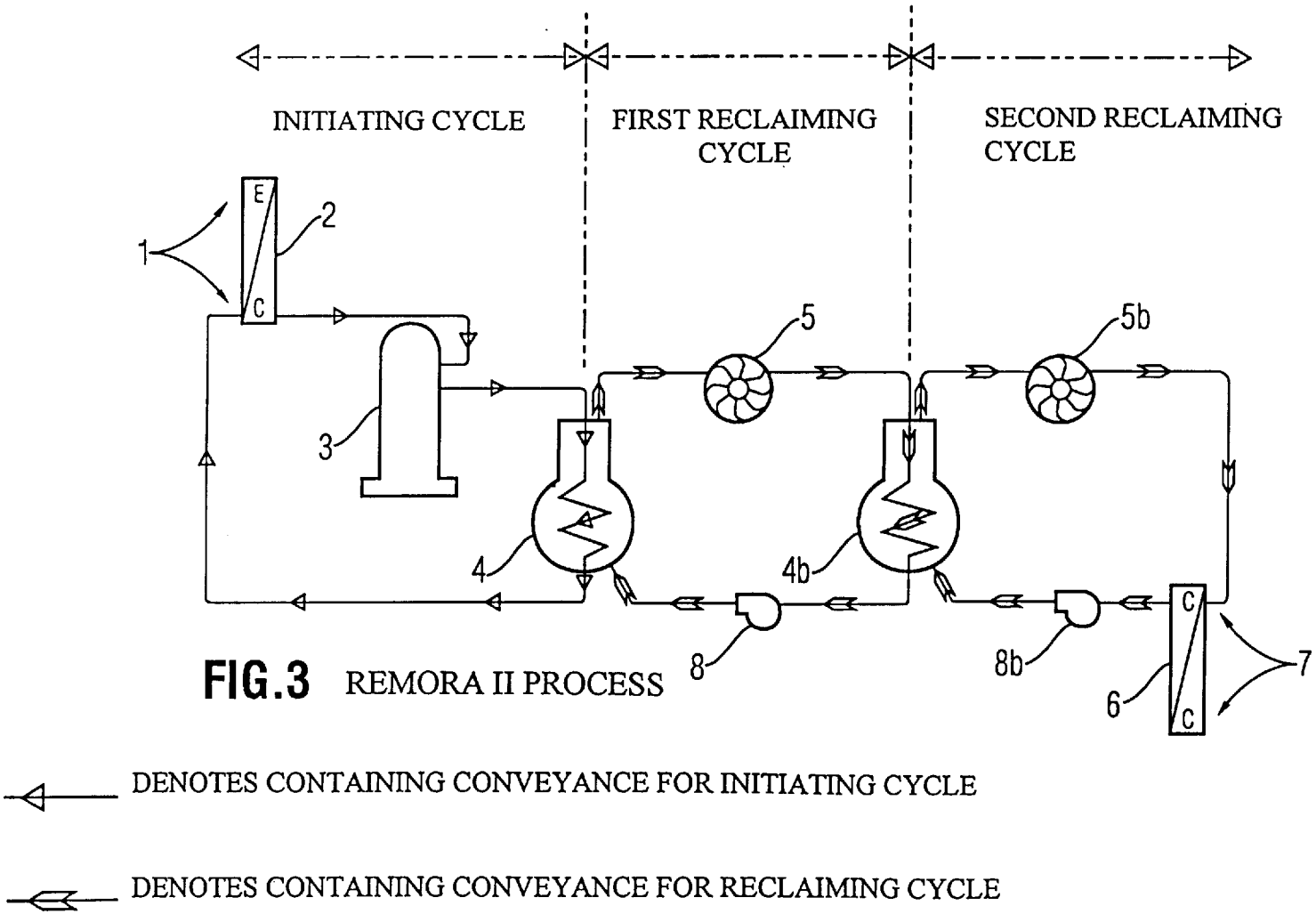
FIG. 3 is a diagrammatic representation having no special scaling of an application of the present invention employing the use of two reclaiming cycles.

If there should be remaining available heat energy that can be further utilized after the refrigerant of the reclaiming cycle has departed from the turbine component, we may wish to make further use of it by adding another reclaiming cycle to the process. Referring to FIG. 3, we see a diagrammatic representation of the Remora II which is comprised of one initiating cycle and two reclaiming cycles. The reclaiming cycles are each depicted making use of turbine components 5 and 5*b*, boiler components 4 and 4*b*, and refrigerant returning components 8 and 8*b*. A notable difference in this application (other than the extra reclaiming cycle), is that the first reclaiming cycle does not make use of a condensing component, but rather another boiler component 4*b* that absorbs remaining available heat energy given off by the first reclaiming cycle into the second reclaiming cycle. Therefore, the condensing refrigerant of the first reclaiming cycle becomes a heat source medium of the second reclaiming cycle. Thus, the remaining heat energy present in the first reclaiming cycle's refrigerant which would normally be given off to the heat rejection medium from the condensing component, is now brake energy applied against the second reclaiming cycle's turbine component 5*b*. But, it is believed, that the additional reclaiming cycle will drive up each successive boiler component's operating temperature sequentially up the line by its added resistance, increasing the work load of the initiating cycle and causing the need of additional applied energy to overcome this added resistance. It is also believed that this said increase in boiler temperature (s) may limit us in such an application due to the increase in the condensing temperature of the initiating cycle, especially if even more reclaiming cycles would be desired, and so on.

Figure 4:
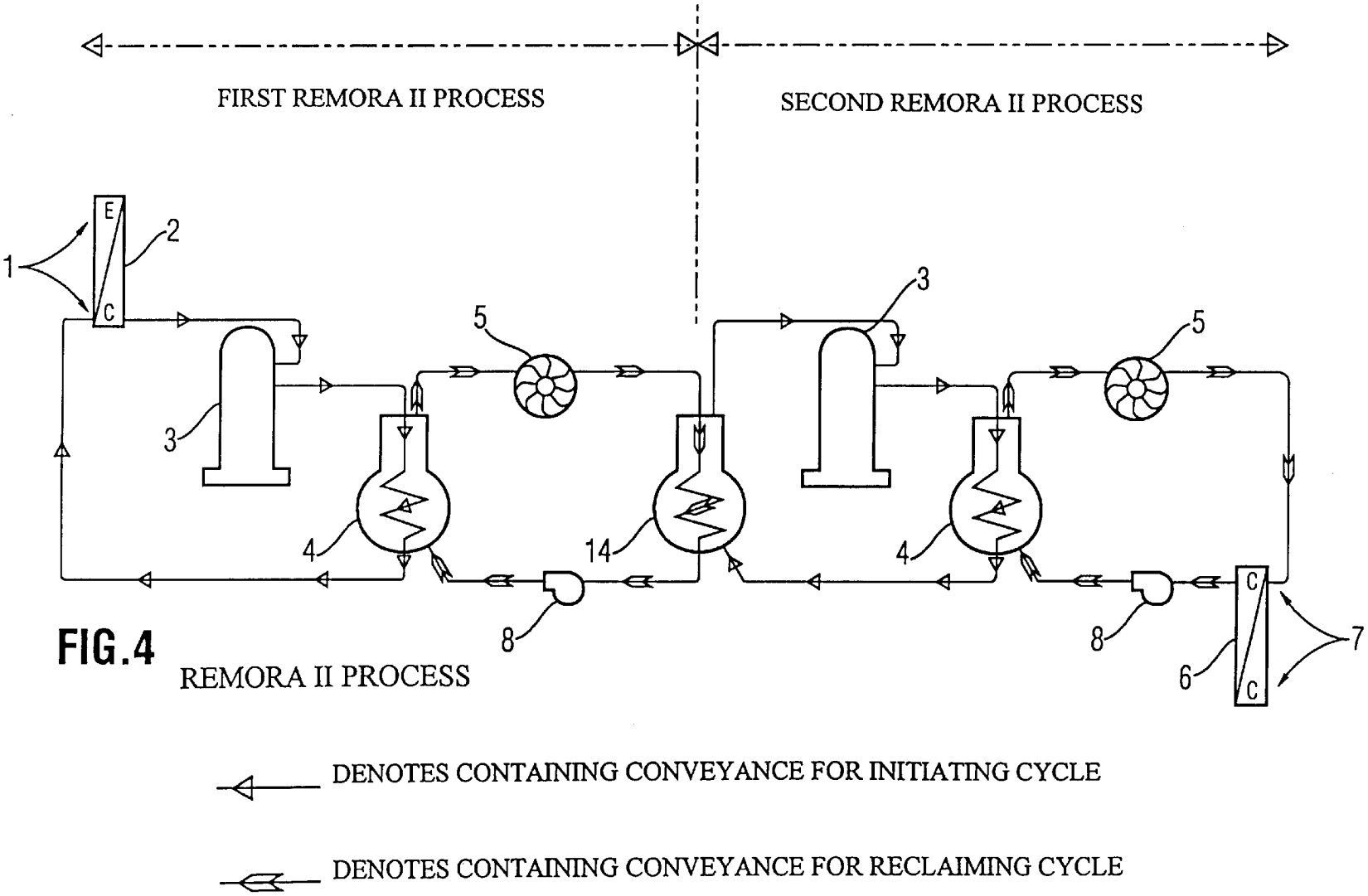
FIG. 4 is a diagrammatic representation having no special scaling of an application making use of two Remora II processes joined together in a cascading fashion.

Referring to FIG. 4, we see a cascading type of arrangement. In this instance, two Remora II processes are linked in a series, in which the first Remora II gives off remaining heat energy from its condensing reclaiming cycle to the evaporating initiating cycle of the second Remora II. It does so essentially through a boiler component; but we will refer to it as a condensing/evaporating component 14, in order to avoid confusion in our discussion. Its operation is like a boiler component, but the evaporated refrigerant of the second Remora II initiating cycle is drawn out of the condensing/evaporating component believed mainly with the refrigerant driving component 3 of the second Remora II process, rather than the believed mainly expansion power of the evaporating refrigerant, as in a boiler component. It is believed that the condensing temperature of the first Remora II reclaiming cycle can be designed to be at a lower temperature than it would have been giving off its heat energy to the heat rejection medium 7. It is also believed that the evaporating refrigerant of the second Remora II initiating cycle can be designed to be at a higher temperature than it would have been obtaining its heat energy from the heat source medium 1. Thus, the two aforementioned condensing and evaporating situations is believed to result in more efficient initiating cycles in both processes, therefore, allowing both initiating cycles to share the work duty between them. But it is believed that any added resistance, such as that due to the additional cycles and the additional turbine component, must be overcome with additional applied energy. It is believed that linking even more of these Remora II processes should be an easier task than the additional linking discussed regarding FIG. 3.

When describing the prior art earlier in this writing, we noted that absorption processes were believed typically not as efficient as the compressor driven systems, and that it was believed to be a less likely application with the Remora II. But because of the believed possibility of using this technology with the Remora II, FIG. 5 has been included.

Figure 5:
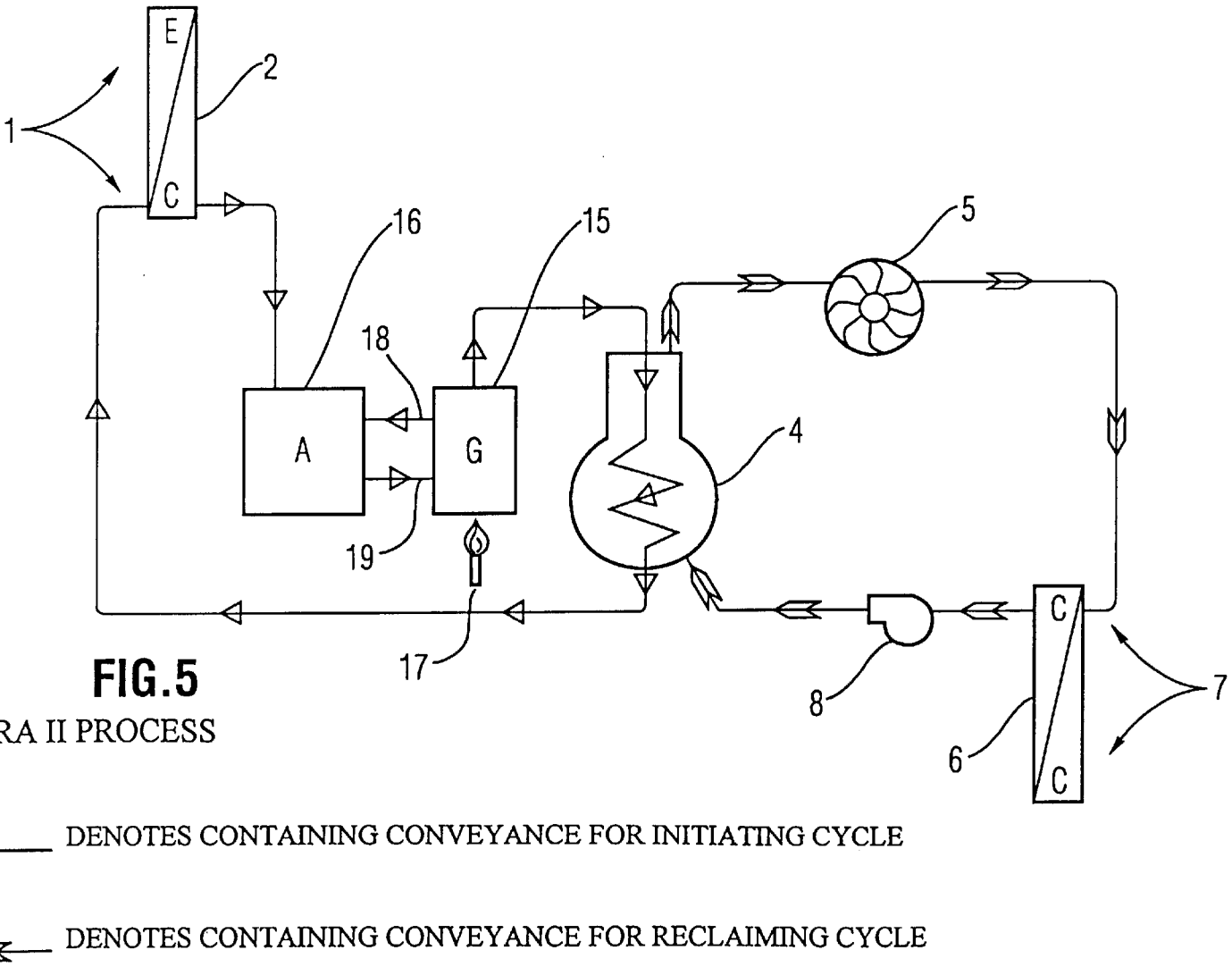
FIG. 5 is a diagrammatic representation having no special scaling of an application of the present invention employing absorption refrigeration principles.

Looking at FIG. 5, we see that the refrigerant driving component has been substituted by two generalized components comprised of: a generator component 15; and an absorber component 16. These two components, acting together, essentially are believed to accomplish the same thing as a refrigerant driving component, such as a compressor. Again, the described events that follow are assumed to be happening simultaneously in a cyclical fashion once the process is in operation and all the described events are taking place. Contained within the initiating cycle are two mediums comprised of: a refrigerant; and an absorbant. Applied heat energy 17 is added by applicably selected means to the absorbant/refrigerant mixture contained in the generator component 15, causing gaseous refrigerant to separate from the absorbant and leave the generator component 15, through a containing conveyance by applicably selected means to the boiler component 4, where it gives off heat energy to the refrigerant of the reclaiming cycle (as discussed earlier in this writing). The separated absorbent (or a largely strong absorbant solution) is transported by applicably selected means through a containing conveyance 18 to the absorber component 16. The believed condensed refrigerant of the initiating cycle by applicably selected means leaves the boiler component 4 by way of a containing conveyance to the evaporating component 2, where the refrigerant evaporates and receives heat energy from the heat source medium 1 (as previously was discussed). It then leaves the evaporator component 2 by way of containing conveyance by applicably selected means to the absorber component 16. The believed evaporated refrigerant is absorbed by the strong absorbant mixture that is present and/or entering the absorber component 16, and some heat energy is given off during this event by applicably selected means through the external surface of the absorber component 16. Optimally (depending on the need(s) of the application), some or all of this heat energy given off at the absorber component may be transferred back to the refrigerant(s), as discussed earlier regarding absorbing available heat energy into the process. This absorbant/refrigerant mixture leaves the absorber component 16 by way of applicably selected means through a containing conveyance 19 to the generator component 15, to be separated again, thus completing the initiating cycle. Though not shown in the drawing, it is believed that those who apply absorption system design should be aware that heat interchanging through a heat exchanger may be done between the strong absorbent leaving the generator component 18 on way to the absorber component and the absorbant/refrigerant mixture leaving the absorber component 19 on way to the generator component. Absorbtion applications can vary for a number of reasons, but this diagrammatic representation is believed to be useful in your possible application(s).

Let us analyze what we have learned. Assume we have a need to apply refrigeration, and that we have some given refrigerant evaporation and condensing temperatures (or a given design range of temperatures). Assume that we implore the use of a basic Remora II process instead of a more typical refrigeration application which does not make use of a reclaiming cycle; that the design evaporation temperature, or design range of evaporation temperatures, is/are that of the evaporated refrigerant leaving the evaporating component of the initiating cycle; and the design condensing temperature, or design range of condensing temperatures, is/are that of the condensed refrigerant of the reclaiming cycle leaving the condensing component. Also assume that there is additional resistance in the process due to the use of the reclaiming cycle than would be associated with a more typical refrigeration application; and this additional resistance results in a greater work load; and this additional work load requires more applied energy to move an amount of heat energy through the process than would have been encountered in the more typical refrigerant application.

Therefore, when the Remora II process is started, it is believed to consume more applied energy than the more typical application, thus the Remora II would be less efficient at that time. But once the process is in operation, the turbine component spins the axis or axle attached to it which results in kinetic energy which is utilized, thus, in effect, reclaiming some of the heat energy that is moved through the process. How much heat energy is reclaimed is believed to be mainly dependant on the reclaiming efficiency of the turbine component. At the time of this writing, it is believed that the typical major influence in the expected efficiency of a turbine component is the amount of brake energy that is encountered by the turbine component. Therefore, the amount of reclaimed energy should be expected to vary with differing amounts of available heat energy that are moved through the process.

Additionally, the amount of reclaimed energy actually utilized is a result of further losses in converting the reclaimed energy to a desired form of energy for some application. For example, assume that the spinning axis attached to the turbine component is used to turn an electrical generator, and the generator is 90% efficient. In such a case, 90% of the reclaimed energy is utilized for our purpose. Therefore, what is important when applying the Remora II is how much energy is utilized. And for the following generalized analyses, assume that applied energy has a cost to us, and therefore should be minimally used.

Based on what has been previously discussed in what is believed to be a representative argument, if the additional applied energy required by the Remora II (over the more typical application) is greater than the amount of utilized energy, then it is believed that the Remora II should not be used for the application and/or a review of the suitability of the components used to implement the process should be made. If the amount of utilized energy is greater than the additional applied energy required by extra resistance in the process, but less than (or equal to) the total applied energy required, then the Remora II is believed to effectively be more efficient than the more typical application would have been. If the amount of utilized energy is greater than the total amount of applied energy, then we may want to reconsider our goal(s) of merely applying the process for traditional refrigeration. That is, we may want to keep the process in operation for as long as practically possible.

One method that may be used to keep the process in operation is to use heat energy given off by the reclaiming cycle to add heat energy to the heat source medium to help facilitate continuous operation of the Remora II. We have already discussed transferring sources of heat energy back to the heat source medium and/or the refrigerant(s) of the process in order to utilize it. Available heat energy believed rejected from the reclaiming cycle (more than likely before or at the condensing component, but after the remaining heat energy leaves the turbine component) can be added to the heat source medium by applicably selected means comprising the following: adding rejected condensing heat energy to the heat source medium that is not functionally remote and, therefore, acts on the evaporating component in quick fashion; and adding rejected condensing heat energy to the heat source medium that is functionally remote, so as not to act quickly on the evaporating component, such as in a re-heat comfort application. Both of these reuse (or recycle) heat energy that travels through the process (accept for possible heat loss due to transmittance). Optional methods of providing means to recycle this available heat energy being rejected by the reclaiming cycle are comprised of: methods similar to what was discussed earlier regarding transferring sources of heat energy back to the heat source medium and/or immersing heat source(s) in the refrigerant(s) to gain available heat energy; using one medium as both a heat source and heat rejection medium; and intertwining the evaporating and condensing components together in such a manner as to directly transfer heat from the exterior surface (s) of the condensing component to the exterior surface(s) of the evaporating component, or by sharing the same exterior surface(s) by both components, and bypassing the use of a heat source and/or heat rejection medium all together.

Let us discuss further the last two methods presented in the previous paragraph. Since we are assuming that we are utilizing more energy that we are applying, we can expect that the process may be used to obtain the utilized energy rather than for a specific heating or cooling purpose. Therefore, we may optionally use one medium to act as both heat source and heat rejection medium. If we assume that the medium is recycled in a circular fashion through the evaporating and condensing components, heat energy would be recycled through the process, except for heat energy that is lost due to transmittance and/or losses at some component(s) and/or removed. Removing heat energy from this dual purpose medium is believed likely if spent heat energy was being used by the process and being made available heat energy (as discussed earlier) and this available heat energy was building at a faster rate than it could be lost to transmittance and/or to losses at component(s) utilized by the process (such as the turbine component). If this available heat energy was building at a rate less than it was being lost to transmittance and/or at components, then it is believed that heat energy would need to be added (more than likely) to the medium. Again, methods of removal and/or addition of this heat energy are believed too numerous to present here and should be obvious to those who apply the principles of refrigeration and/or may be accomplished by the addition of some future invention(s) when applying the present invention.

If the dual purpose medium were not used for this recycling purpose, and heat energy was transferred more directly between the evaporating initiating cycle and the condensing reclaiming cycle, then the evaporating refrigerant of the initiating cycle would be acting as a heat rejection medium for the reclaiming cycle and the condensing refrigerant of the reclaiming cycle would be acting as a heat source medium for the initiating cycle. Technically, it is believed this should improve the efficiency of the process by facilitating a higher evaporation temperature and a lower condensing temperature than the dual purpose medium example in the previous paragraph. But removal of the building available heat energy and/or addition of needed make-up heat energy is believed to result in a more complicated situation of design resulting in heat exchanging with the refrigerant(s) and/or components used by the process.

Finally, let us take a look at using a single medium as a heat source and a heat rejection medium, which is believed to be likely used in a situation where the process is being applied to obtain the utilized kinetic energy and/or condensing a liquid from the medium and not for some heating or cooling purpose, but where we do not use this single medium for heat energy recycling as previously discussed. If we assume that the medium makes a one pass through the evaporating and condensing components, then the sequence of these components is believed to help the efficiency of the process. That is, if the medium passes through the evaporating component on way to the condensing component, then it is believed that this could help lower the temperature of the condensing component. This could have an additional advantage of obtaining a desired liquid from a gas present in the medium by causing the gas to condense and give off latent heat to the evaporating refrigerant of the initiating cycle along with sensible heat obtained from the medium. Conversely, if the medium passes through the condensing component on way to the evaporating component, then it is believed that this helps raise the temperature of the evaporating component.

The foregoing diagrammatic representations of the Remora II Refrigeration Process have been presented for the purposes of illustration and description. It is not intended to be exhaustive or to limit the invention to the precise forms disclosed. Many modifications and variations are possible in light of the above teaching. It is intended that the scope of the invention be limited not by this detailed description, but rather by the claims appended hereto.

I claim:

1. A process wherein included events take place during an interval of time, in which said process converts heat energy to kinetic energy with the use of thermally joined fluid cycles, in which the working fluids in said fluid cycles act as refrigerants, and said fluid cycles are comprised of an initiating cycle and a reclaiming cycle, comprising the steps of causing the working fluid in said initiating cycle to evaporate, become superheated, move through said initiating cycle, and rise in temperature and pressure so the evaporated and superheated working fluid in said initiating cycle will condense and subcool, allowing said working fluid in said initiating cycle to condense to give off heat energy greater than the heat gained only through the evaporation of said working fluid in said initiating cycle to said reclaiming cycle through boiling the working fluid in said reclaiming cycle, and causing the boiled working fluid in said reclaiming cycle to expand and move invoking kinetic energy, and condense, and said process has capacity for use of said kinetic energy that exceeds only direct unconverted mechanical energy which is employed to said move and to cause to said rise in temperature and pressure said working fluid in said initiating cycle, and to move all of the condensed said working fluid in said reclaiming cycle back to the boiling of said working fluid in said reclaiming cycle to be boiled again, and in which said direct unconverted mechanical energy results only in reducing electrical energy directly employed to said move and to cause to said rise in temperature and pressure said working fluid in said initiating cycle and to said move said all of the condensed said working fluid in said reclaiming cycle back to said boiling.

2. The process of claim 1 wherein the boiled working fluid in said reclaiming cycle is superheated by applicably selected means.

3. The process of claim 1 wherein the condensed working fluid in said reclaiming cycle is subcooled by applicably selected means.

4. The process of claim 1 wherein an amount of the condensed working fluid in said reclaiming cycle is returned to the applicably selected means of boiling by applicably selected means to be boiled again.

5. The process of claim 4 wherein heat energy is added to said condensed working fluid in said reclaiming cycle by applicably selected means.

6. The process of claim 1 wherein an amount of the condensed working fluid in said initiating cycle is returned to the applicably selected means of evaporating by applicably selected means to be evaporated again.

7. The process of claim 6 wherein heat energy is added to said condensed working fluid in said initiating cycle by applicably selected means.

8. A process wherein included events take place during an interval of time, in which said process converts heat energy to kinetic energy with the use of thermally joined fluid cycles, in which the working fluids in said fluid cycles act as refrigerants, and said fluid cycles are comprised of an initiating cycle and a plurality of reclaiming cycles, comprising the steps of causing the working fluid in said initiating cycle to evaporate, become superheated, move through said initiating cycle and rise in temperature and pressure so the evaporated and superheated working fluid in said initiating cycle will condense, causing said working fluid in said initiating cycle to condense to give off heat energy to the first reclaiming cycle through boiling the working fluid in said first reclaiming cycle, allowing the boiled working fluid in said first reclaiming cycle to expand and move invoking kinetic energy, and condense, and as said working fluid in said first reclaiming cycle condenses allowing said working fluid to give off remaining heat energy gained by boiling said working fluid in said first reclaiming cycle and after said invoking kinetic energy in said first reclaiming cycle to a second reclaiming cycle through boiling the working fluid in said second reclaiming cycle, and the working fluid in said second reclaiming cycle invokes kinetic energy, and condenses, until no more reclaiming cycles are used.

9. The process of claim 8 wherein the boiled working fluid in at least one of said plurality of reclaiming cycles is superheated by applicably selected means.

10. The process of claim 8 wherein the condensed working fluid in said initiating cycle is subcooled by applicably selected means.

11. The process of claim 8 wherein the condensed working fluid in at least one of said plurality of reclaiming cycles is subcooled by applicably selected means.

12. The process of claim 8 wherein an amount of the condensed working fluid in at least one of said plurality of reclaiming cycles is returned to the applicably selected means of boiling by applicably selected means to be boiled again.

13. The process of claim 12 wherein heat energy is added to said condensed working fluid in said at least one of said plurality of reclaiming cycles by applicably selected means.

14. The process of claim 8 wherein an amount of the condensed working fluid in said initiating cycle is returned to the applicably selected means of evaporating by applicably selected means to be evaporated again.

15. The process of claim 14 wherein heat energy is added to said condensed working fluid in said initiating cycle by applicably selected means.

* * * * *

UNITED STATES PATENT AND TRADEMARK OFFICE

CERTIFICATE OF CORRECTION

PATENT NO. : 5,809,791

DATED : December 22, 1998

INVENTOR(S) : Thomas Ray Stewart III

It is certified that error appears in the above-identified patent and that said Letters Patent is hereby corrected as shown below:

Col. 2, line 7, change 'more' to --move--.
Col. 3, line 42, change 'conclude the discussion of' to --further discuss the--.
Col. 6, line 60, remove 'immersing'.
Col. 8, line 53, change 'evaporate' to --boil--.
Col. 9, line 39, remove 'of the process'.
Col. 10, lines 2 and 3, remove 'of the process'.
Col. 11, line 23, remove 'of the process'.
Col. 13, line 55, change 'not' to --nor--.
Col. 13, line 57, change 'and and' to --and an--.
Col. 14, line 36, remove 'only'.
Col. 14, line 65, after 'component' insert --2--.
Col. 15, line 5, remove 'of the process'.

Signed and Sealed this

Eighteenth Day of May, 1999

*Attest:*

*Attesting Officer*

Q. TODD DICKINSON

*Acting Commissioner of Patents and Trademarks*